United States Patent [19]

Hentzschel et al.

[11] 3,948,070

[45] Apr. 6, 1976

[54] MOTION CONTROL FOR THE FEED MECHANISM IN PILGER ROLLING MILLS

[75] Inventors: Erhard Hentzschel, Aachen; Heinz Schumacher, Ratingen, both of Germany

[73] Assignee: Mannesmannrohren-Werke AG, Dusseldorf, Germany

[22] Filed: Jan. 8, 1975

[21] Appl. No.: 539,588

[30] Foreign Application Priority Data

Jan. 10, 1974 Germany ..... 2401354

[52] U.S. Cl. ..... 72/21; 72/189; 72/252

[51] Int. Cl.[2] ..... B21B 21/04

[58] Field of Search ..... 72/21, 189, 252; 310/17, 310/19, 28; 318/35, 39

[56] References Cited

UNITED STATES PATENTS

| | | | |
|---|---|---|---|
| 1,474,124 | 11/1923 | Steinecke | 72/252 |
| 3,439,241 | 4/1969 | Martens | 318/39 |
| 3,602,994 | 9/1971 | Layman | 318/39 |
| 3,662,585 | 5/1972 | Bellmann | 72/252 |
| 3,676,760 | 7/1972 | McDaniel | 318/39 |
| 3,681,629 | 8/1972 | Drye | 310/30 |
| 3,728,597 | 4/1973 | Cummens et al. | 318/39 |

*Primary Examiner*—Lowell A. Larson
*Attorney, Agent, or Firm*—Ralf H. Siegemund

[57] ABSTRACT

The feed mechanism for a pilger or Mannesmann rolling mill is driven by an electrical linear motor which is controlled on the basis of two pulse trains. One train is derived from the rolls, the other one from the reciprocating motor. The control is carried out to distinguish between a constant speed phase during a rolling pass, an acceleration phase for advancing the feed mechanism and a deceleration phase to obtain reversal ahead of re-engagement of the bloom by the rolls for the next rolling step.

10 Claims, 6 Drawing Figures

MOTION CONTROL FOR THE FEED MECHANISM IN PILGER ROLLING MILLS

BACKGROUND OF THE INVENTION

The present invention relates to the control of the feed mechanism for hot or warm rolling mills of the pilger variety, for rolling a hollow bloom in sections, under utilization of a process sometimes called Mannesmann process or reciprocating rolling.

The feed mechanism in such rolling mills are usually constructed to operate on the basis of thermodynamics in the general sense. For example, pneumatically operated piston drives and liquid brakes are used here. These fluid type devices pose, of course, the usual problems of sealing, cavitation, maintenance and wear. But not only that, they have additional, operative limitations. For example, the mandrel rod of the feed mechanism must be moved against steadily increasing compressive pressure. Another limitation is the rather short period of time needed to adequately accelerate the masses to be moved. Thus, the compression of operation fluid is the higher the faster one has to operate the feed mechanism. Construction and maintenance are correspondingly high for these devices.

Certain more or less spontaneous and unexpected changes in the control of these known feed mechanisms are unavoidable because it is, for example, very difficult to synchronize advance and retraction in the feed mechanism with the rotation of the rolls. It may occur that the front point of reversal of the feed mechanism is exceeded. The resulting strong load on the rolls and drive spindles may lead to fractures. Progress in the field of pneumatics and hydraulics have not remedied these problems.

SUMMARY OF THE INVENTION

It is an object of the present invention to provide for a new and improved control and drive for the feed mechanism in pilger rolling mills obviating the deficiencies of thermodynamic systems.

In accordance with the preferred embodiment of the present invention, it is suggested to drive the feed mechanism of a pilger rolling mill by means of a particular electrical linear motor which is servoed in response to signals derived from the rolls in that their progressing angular positions and speed are ascertained to control the linear motor in a feedback loop, which includes feedback of speed and position of the feed mechanism as controlled by the linear motor. The servo control of the linear motor should be such, that the reversal of the feed mechanism from advance to retraction occurs ahead of re-engagement of the bloom by the rolls for the next pass so that by the time of that re-engagement the feed mechanism moves already in the direction assumed during rolling proper. This way, rolls and spindles are relieved from (unnecessary) excess load, particularly in the onset phase of a pass.

In the preferred embodiment, pulse trains are derived from the rolls and from the linear motor through suitable transducers. The respective speed is represented by the pulse rate frequency, and pulse counting tracks progressive positions. The various quantities can be combined or are interrelated on the basis of known relations which are being used to control the various phases of a complete cycle of reciprocating motion of the feed mechanism, while on the other hand the rotational phase positions of the rolls as metered by pulse counts determines where the feed mechanism is supposed to be in any instant. This way, the point of reversal of the feed mechanism from advance to retraction can be accurately metered on the basis of pulse counting, and the duration of the pass in terms of caliber angle of the rolls is likewise metered. The motion of the feed mechanism inbetween these critical points is metered, tracked and controlled so that not only is the feed mechanism returned (advanced) within the required period, but its forward point of reversal is determined as to time and location with utmost accuracy, and the subsequent rolling pass finds the feed mechanism retracting commensurate with the rolling speed.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a main operating rod 1 of the feed mechanism disposed in a casing 3. The rod 1 projects beyond casing 3 and terminates in a mandrel lock 2 for connection to the mandrel inserted in a hollow bloom or tube 13. The rolls of the pilger mill are denoted with reference numeral 10. The rolling equipment to the left of rod 1 is conventional for this type of mill.

Figure 1:
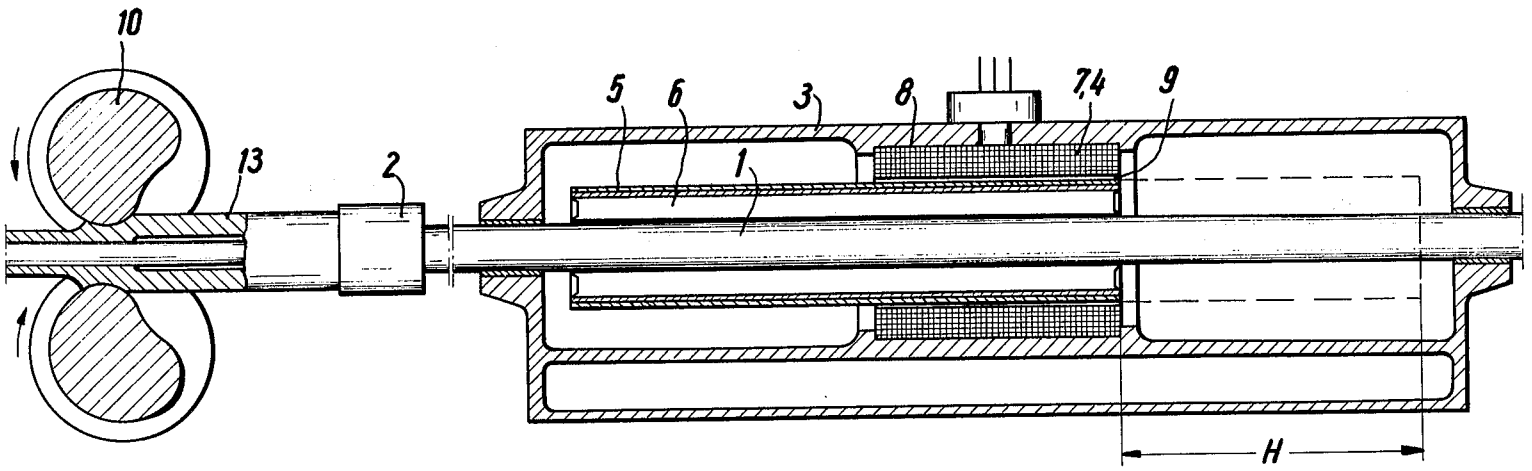
FIG. 1 is a longitudinal view through the feed mechanism in a pilger rolling mill.

Rod 1 carries the movable portion 5 of an electrical, linear motor 15. This secondary portion or armature 5 of the motor is made of iron and has/longitudinal carrier 6 constructed of aluminum with longitudinal passages 6a for cooling air. The air has been filtered to be free from any iron (or, more generally, ferromagnetic particles). The primary or stationary part 4 of linear motor 15 includes stator coils 7 and active pole surfaces 8 cooperating with movable part of the linear motor. A very accurately predetermined air gap 9 is provided between the active pole surfaces 8 and coils 7 on the one hand, and the movable part 5 of the motor on the other hand. The primary portion or stator 4 of the linear motor as well as the secondary portion or plunger 5 include separate magnetic return paths.

Figure 2:
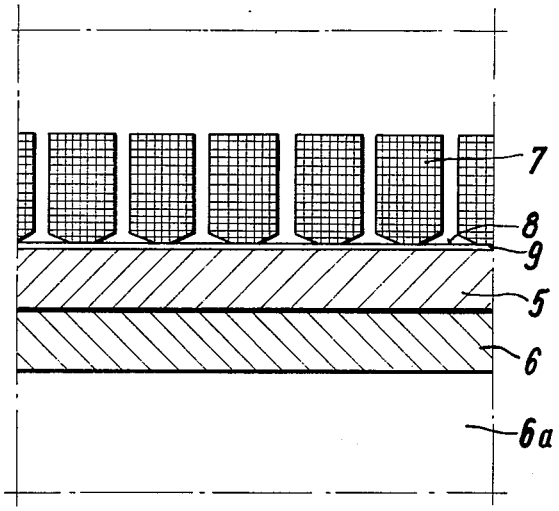
FIGS. 2 and 3 show certain details in the linear motor used in the device of FIG. 1.
Figure 3:
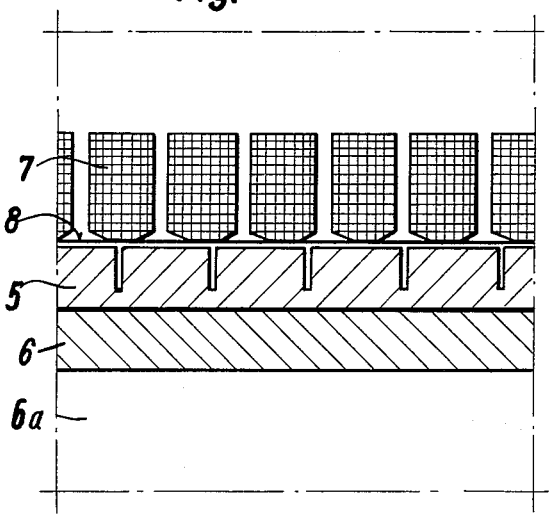

Upon energization of the coils 7, rod 1 is moved by the stroke length H in one or the opposite direction depending on the phase of the a.c. voltage applied to the stator coils. FIGS. 2 and 3 differ in that the magnetic poles of the movable part 5 are additionally separated by notches.

Figure 4:
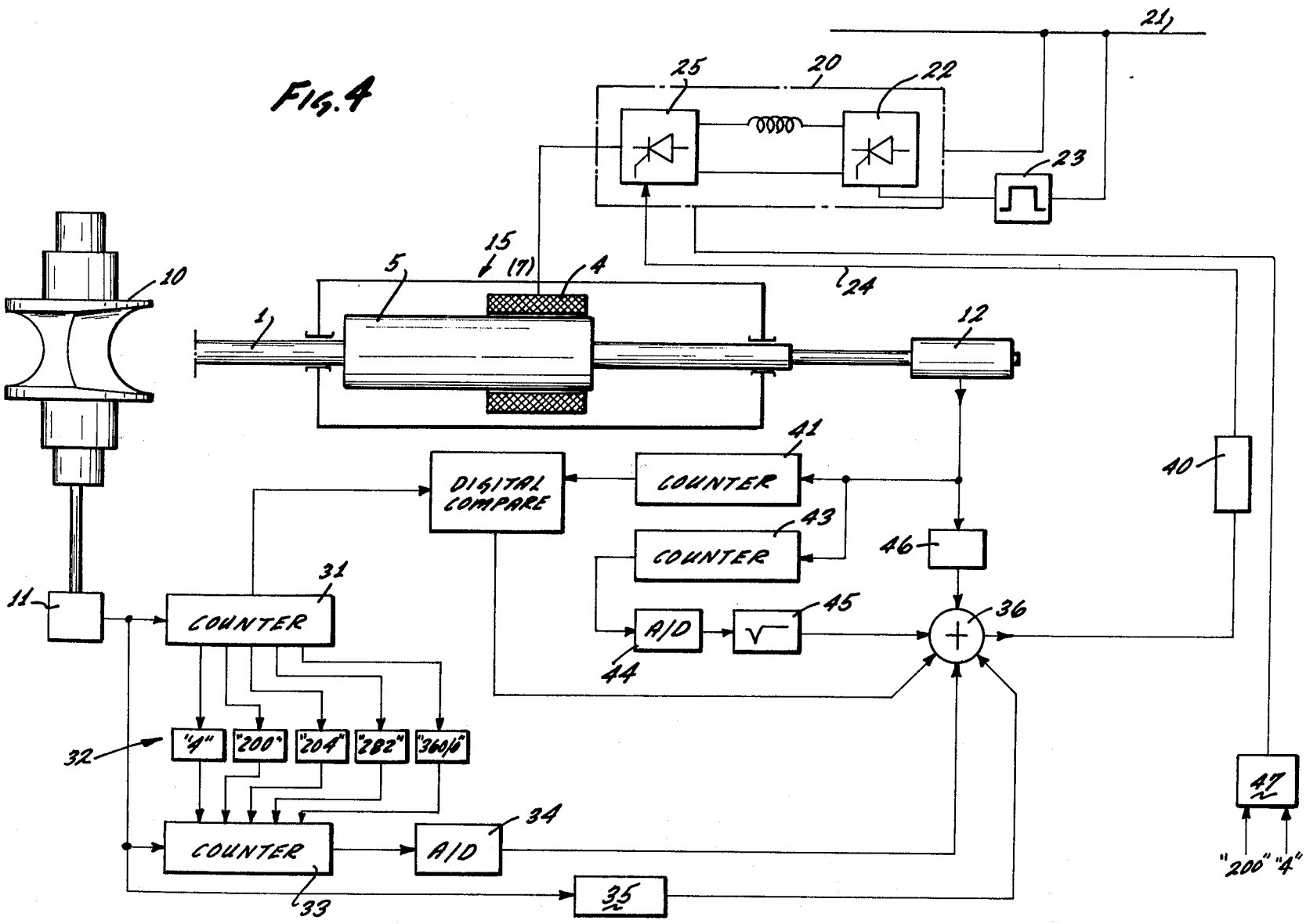
FIG. 4 is a block diagram of a control circuit for the linear motor in the feed mechanism.

Turning now to FIG. 4, we proceed to the description of the electric circuit for operating the linear motor 15. The circuit includes primarily a power and drive speed control circuit 20 for the linear motor, particularly for the coil system 7 of the stator 4 thereof. The circuit includes additionally a feedback control circuit 30. The drive circuit 20 is constructed as a a.c.-d.c.-a.c. conversion unit receiving power, for example, from a three phase supply system 21. The circuit 20 includes a rectifier portion 22 connected to the power mains 21 and is conventionally constructed for example from thyristor elements or the like. Additionally, a control circuit 23 of conventional design operates the rectifier 22.

The d.c. output circuit of rectifier 22 is connected to the d.c. input circuit of an inverter 25 which provides an a.c. voltage of variable frequency. In particular, the frequency of the inverter 25 is controlled by an input signal (d.c.) in a signal path 24. The inverter may include a VCO for the production of control pulses at a frequency determined by the level of the signal in line 24.

The circuit 20 has, in addition, a control input line 26 which holds a signal for determining the direction of movement of motor 15. The signal may, for example, determine the phase of the a.c. output of inverter 25, as applied to stator coils 7.

The feedback control of the motor as to speed, position and direction results from several inputs, whereby specifically, the motion of the feed mechanism is to be carried out in particular relation to particular phase points passed through by rolls 10 during their rotation. Accordingly, the angular progression of the rolls 10 is to serve for the generation of command inputs for the motor.

A transducer 11 is coupled to the rolls (or the roll drive or spindles or just to one of the rolls) to provide a train of pulses. Transducer 11 may include a magnetic or optical disk with equidistantly markings. A magnetic or optical pick up scanner or detector is disposed to provide a series of pulses accordingly. Each pulse represents a particular incremental angle of rotation of the rolls, and the number of pulses produced for one revolution represents, accordingly, one complete revolution of the rolls. The pulse rate frequency represents the speed of the rolls and, during each pass, the speed of rolling.

A transducer 12 produces pulses which represent the movement of feed mechanism rod 1. The transducer may also be of the rotational variety geared to rod 1 by a rack and pinion arrangement. Alternatively, transducer 12 may be of the linear variety in which a linear grating of some kind (optical, magnetic, mechanical) is affixed to rod 1 and a stationary transducer (optical, electromagnetical feeler) scans the passage of that grating. The gratings may have, for example, ten lines per millimeter.

The motor undergoes reciprocating motion so that the movable portion of the transducer will reverse. This could result in missing pulse counts, but if the resolution is sufficiently fine the resulting error may be slight. Conceivably the transducer 12 is driven by a reversible drive so that in fact it maintains its direction of rotation.

Each of the transducers 11, 12 may additionally respond to a separate marking and provide a separate pulse representative of completion of a cycle. For example, tranducer 11 may, in a separate line, provide a particular pulse whenever the rolls pass through a selected zero position of their rotation. Transducer 12 may provide, also in a separate line, a particular pulse for example on each reversal of motion from advance to retraction.

The control circuit 30 uses the pulses from transducer 11 to generate specific command signals for the linear motor and the pulses from transducer 12 are used to close the loop for feedback control of the feed mechanism. Before, however, describing the circuit 30 in greater detail, the desired motion for the linear motor and the feed mechanism of the pilger rolling mill will be outlined with reference to FIGS. 5 and 6.

Figure 5:
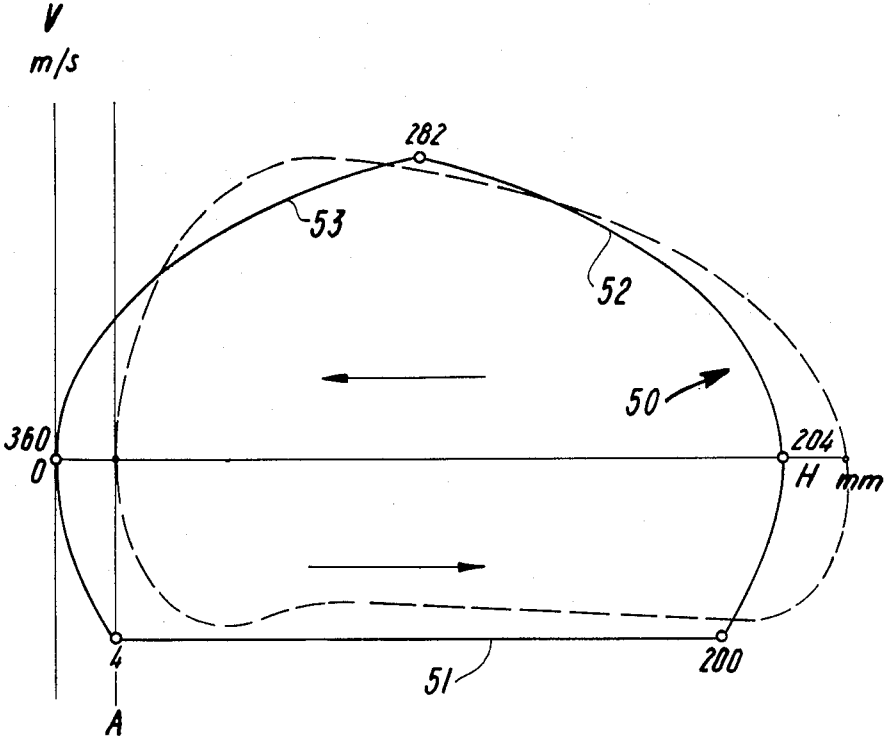
FIG. 5 is a speed-travel path diagram for the controlled motion of the feed mechanism.

The control to be realized by control circuit 30 is designed to obtain a velocity profile having contour of a close loop and depicted in FIG. 5 as a solid drawn curve 50. Specifically, the curve denotes speed or velocity of the motor 15 plotted against positions of the plunger and of the movable portion 5 thereof. Different positions define displacement of the motor. The circuit 30 has as its primary function the generation and maintaining of the profile, in closed loop operation and on the basis of roll position signals issued by transducer 11. As stated, transducer 11 provides a sequence of pulses which individually denote rotation of the rolls 10 through a particular angle. For reasons of ease of description it may be presumed that a complete revolution of the rolls results in 360 pulses so that each pulse represents an angle of rotation of one degree. In reality, however, the number of pulses could be considerably higher as that would facilitate processing of the pulse train signals as a.c. signals of not too low a frequency and frequency band.

Figure 6:
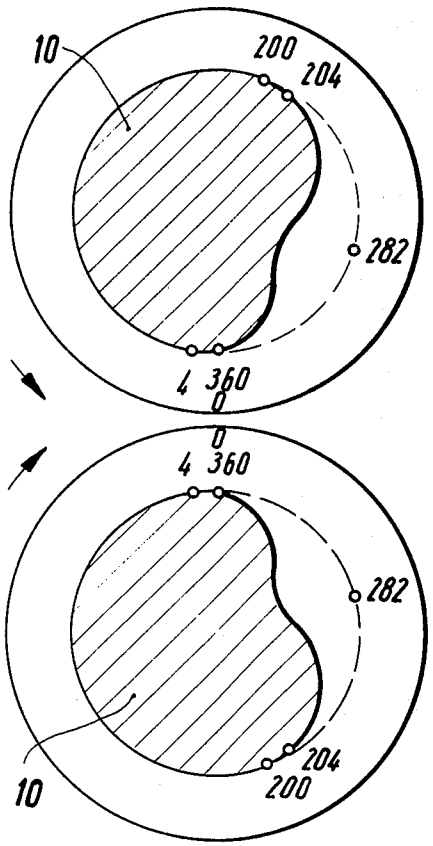
FIG. 6 shows a section view through the pilger rolls under demarkation of phase and angle points used also in FIG. 5.

FIG. 6 shows the rolls 10 and the numbers plotted around a circle represent angular positions. The particular position illustrated corresponds to zero (or 360°) angle position, being 4 degrees ahead of the position 4 wherein the rolls are to engage the bloom. This 360/0 position of the rolls marks the phase in which the linear motor is to reverse. The range of rolling proper covers about 200 pulses and about 160 pulses span the range inbetween two work passes. Angle or pulse count 282 is the midpoint position between the previous and the next pass; position 204 represents the roll phase of disengagement from the bloom.

The velocity profile to be generated for the feed mechanism is correlated to the angular positions and phases of the rolls as follows; the numbers plotted to specific points of curve 50 represent these angular positions of the rolls, and the pulses derived from transducer 11 are used to generate that profile.

The velocity profile has basically three branches. Branch 51 is a constant speed portion, wherein the feed mechanism retracts at a speed commensurate with the concurring roll operation, whereby the retraction of the feed mechanism actually supports the movement of the bloom imparted upon it by the rolling process. This constant speed branch is to extend from roll position and pulse count 4 to position and count 200.

Following the constant speed operation, the feed mechanism is decelerated and accelerated in the opposite direction at as high a rate as possible. One may operate here with a constant deceleration-acceleration rate for the feed mechanism and the linear motor so that the velocitypath characteristics is or is approximated by a parabola, because speed V is proportional to the square root of displacement path S for constant acceleration or deceleration with S being measured from a stop position. The proportionality factor being the square root of twice the acceleration or deceleration rate.

Branch 52, therefore, denotes the parabolic velocity in the deceleration phase as following the constant speed with reversal of direction of motion occurring at angle and pulse count 204 and being continued along the same parabola as acceleration.

Acceleration continues until, for example, the midpoint position of the feed mechanism is reached, which occurs at count state and phase point 282 for rolls, and should occur at a corresponding count for the linear motor transducer feedback 12. Upon passing that point, the motion of linear motor 15 is changed again to another deceleration phase, so that for constant deceleration the profile follows another parabola 53 until reaching the most advanced position to be generated for phase position 360°/0° of the rolls. The linear motor is controlled for reversal at that point and accelerates again, still along that parabola 53, until reaching phase point and pulse count 4, whereupon control is changed to constant speed.

Specifically with regard to the last transition phase, it can be seen that during the branch portion 0°-4° (or pulse count zero to pulse count 4) the feed mechanism is accelerated in the direction of motion of the bloom during rolling. During that period, and preferably as close as possible to the transition point to the constant speed phase (point A-pulse count 4) rolls 10 re-engage the bloom for the next pass, so that the engagement is carried out under conditions of similar speed or at least with minimal speed differences as between the respective engaging points. As one can see, the feed mechanism is actually caused to overshoot on advance in that its forward reversal point is too far ahead. The feed mechanism is caused to retract, therefore, before the rolls 10 have turned to re-engage the bloom.

It can thus be seen, that circuit 30 is to provide the necessary control signals to obtain (a) a constant speed phase during rolling, (b) a deceleration/acceleration phase to reverse movement of the feed mechanism (c) a deceleration/acceleration phase to slow the feed mechanism and reverse it for exactly the phase position of the rolls needed to begin rolling without having to use the rolls for stopping the feed mechanism.

Of course, the average speed of the feed mechanism must be higher on advance than during rolling, because the angular range of the rolls for rolling is larger (above 200°) than the contour portion during which the feed mechanism must advance (about 160°), while on the other hand, the stroke length H for the linear motor is the same.

It is not essential but convenient to operate with two phases of constant deceleration/acceleration for purposes of rapid stopping, reversing and advance of the feed mechanism following a roll pass. However, operating with acceleration up to the midpoint does indeed advance the feed mechanism in the fastest possible way without requiring mechanical breaking. Choosing the midpoint (282) as changeover depends on using the same acceleration/decelerations rates (but with opposite sign). If these rates differ, then the parabolas have different contour and will intersect in a different point to be chosen in that case for changeover. Decisive is, that deceleration/acceleration branch 53 zeros-in on a forward point reversal of the linear motor, so that the rolls engage the bloom for the next pass under conditions in which the bloom moves already in the same direction.

It should be mentioned, that the dashed curve in FIG. 5 represents an example for the velocity profile of a conventional feed mechanism of pilger rolling mills and using thermodynamic principles of operation. The curve teaches that the frontal point of reversal coincides with the point (A) of engagement between rolls and bloom. Reversal and reacceleration of the bloom and feed mechanism has to be carried out in parts by the rolls themselves and additionally rolling has to begin already right at that point. The resulting, excessively high torques were frequently the cause for fractures of the rolls or the drive spindles.

By way of example the control can be realized in the following manner. As stated, the pulse train from transducer 11 is used (1) to ascertain the particular angular phase of the rolls in each instant; (2) to generate the required velocity profile for the motor in dependance upon the progressing positions of the rolls and (3) to track the actual speed of the rolls. The pulse train from transducer 12 is used to track the position and speed of the linear motor.

In accordance with the principle rotational phase tracking function to be provided for by circuit 30, the train of pulses from transducer 11 is fed to a counter 31 which recycles after 360 pulses, i.e. with each revolution of the rolls. In order to ensure proper phasing and to avoid accumulation of errors as could result from missing clock pulses, a specific reset pulse may issue from transducer 11 in phase position 360°/0°, as was mentioned above.

Analogously, the motion and displacement of motor 15 is tracked via transducer 12 in that a counter 41 is used for counting the pulses issued by that transducer. Counter 41 can be constructed as an up and down counter. It's count state must be distinguished from the state of counter 31. The various phase counts frequently alluded to refer always to roll phases and the respective state of counter 31. Counter 41 counts e.g. up from a point of motor reversal corresponding to phase position 360°/0°. Counter 41 counts down from reversal from retraction to advance, which is to coincide with roll phase and count 204.

A plurality of count state detectors 32 are connected to counter 31, they have been labeled in accordance with the respective pulse count state and number they are supposed to detect. The function and purpose of these and other elements will be explained next and pursuant to the description of a complete cycle.

Beginning with position "0", the linear motor is to be controlled for acceleration in continuation of profile 53 (FIG. 5). Accordingly, the pulses from transducer 11 are passed to a counter 33 whose input has been enabled by the "360/0"-detector for forward counting. Counter 33 counts pulses which meter the progression of the linear motor following reversal from the forward most, advance position. Thus, a velocity profile portion of parabolic contour in a speed-path diagram has to be synthesized.

It must be realized that the pulses of the train from transducer 11 meter angular increments as well as time because the rolls are presumed to run at constant speed. Hence, counting of the pulses from transducer 11 produces a time linearly increasing signal which in turn can be interpreted as a signal representing a speed command signal under conditions of constant acceleration, because speed is proportional to elapsed time with acceleration being the proportionality factor. Therefore, the output of counter 33 is converted into an analog signal in a circuit 34, and this analog signal represents the velocity which the feed mechanism should traverse following the stop on phase point 360/0. The signal provided by A/D conversion circuit 34 serves, therefore, as speed input command wherein speed increases linearly with elapsed time from the reversal and starting point for feed mechanism retraction. Such a speed command is equivalent to a parabola in the speed-travel path diagram for motor 15.

In order to phase-track the linear motor throughout, its progression is metered by counter 41 which is connected to receive the pulses from transducer 12. A motor speed synthesizing network is provided for purposes of feedback, using a concurrently operating counter 43 receiving also the pulses from transducer 12. These pulses, as stated, represent linearly the progression of the linear motor as to travel path, but in time variable fashion corresponding to any speed variations of that motor.

The output of counter 43 is converted into an analog signal in a circuit 44, representing travel path from the point of reversal of the linear motor. A circuit 45 establishes the square root of that analog signal and provides a speed feedback signal accordingly, also representing the parabolic contour of the branch 53 between roll phase and count states 0 and 4, as far as the counting of pulses of the roll phase tracking tranducer 11 is concerned.

For purposes of motor control, the command signal from velocity profile synthesizer 34 is fed to a summing point 36. The output of circuit 45 is fed also to summing point 36, but with negative sign. For reasons of stabilization, an actual speed signal is derived from transducer 12 through a circuit 46 which converts the pulse train from transducer 12 into a speed signal (or a separate, speed representing signal is derived from the linear motor).

Summing point 36 may actually be comprised of a resistor network which sums (or subtracts) the signals it receives and at appropriate levels. Summing point or circuit 36 can be construed as an input circuit for an amplifier circuit 40 amplifying the summed signal and, if necessary, converting it into a suitable level, to control the signal for line 24, which in turn controls the inverter 25 for controlling the stator coils 7 of motor 15.

The control should be sufficiently tight (high gain), so that the position of the linear motor follows the phase, for example, within about one pulse count (transducer 11). This, however, depends on the actual frequency of the pulse trains. For the assumed case of 360 pulses per roll revolution, a control for maintaining the relative positions of motor and rolls within one pulse count is readily realizable. This, of course, presupposes that the velocity $V \sim t \sim \sqrt{S}$ remains within the dynamic constraints of the motor, and that the motor can readily accelerate at the particular acceleration rate which determines the proportionality between speed and square root of travel path S, as outlined above.

The circuit 40 should be adjusted to adapt the control system to the dynamics of the feed mechanism and to take inertia into consideration and to avoid unnecessary oscillatory control as long as the actual speed remains within the prescribed tolerance.

It should be mentioned further that if the electric connection between inverter 25, its immediate control and stator 4 includes stabilization as to a limit of acceleration to the same level estabished by the signal from circuit 40, then the parabolic profile portion from 0 to 4 does not have to be synthesized but the constant speed phase to follow may actually be established on state and phase 360°/0°, and the actual velocity profile will follow that parabola 53 anyway, by operation of a resistive feedback in the motor circuit.

The linear motor is, therefore, servoed to reach a particular speed at phase count 4. This is the point of engagement of the retracting bloom with the rolling contour of rolls 10. The acceleration (proportionality factors in circuit 34, 44, 45) is selected so that the roll speed is reached at that point (point A). At this point, the counter 43 has reached a particular count number corresponding to a particular distance traversed thus far by the linear motor and as metered by transducer 12. That number cannot be expected to be equal to four.

Following phase count 4, the linear motor is to be servoed to run at constant speed. Detector 4 of the detectors 32 signals that change in operation and provides for the necessary switching and control. The roll speed is derived directly from transducer 11, by a circuit 35 analogous to 46, to obtain the roll speed signal as reference for velocity profile 51. The output of circuit 34 is turned off (or counter 33 is reset to zero so that 34 will produce a zero level output, but that is not practical for reasons below). The speed signal from circuit 35 is used as reference. Summing circuit 36 continues to compare that reference with the actual speed feedback of the linear motor as derived through 12/46, and inverter 25 is controlled to maintain constant speed of the linear motor. Circuit 45 (or 44) are also turned off, and counter 43 will no longer receive signals from transducer 12 and halts.

During the constant speed phase of actual rolling, the feed mechanism retracts under motor control. The speed level is the same as the speed imparted upon the bloom as the result of rolling, so that the linear motor operates as relief.

An additional position correction is provided for in the constant speed phase, in that the count state of counter 41 is compared with the progression of counter 31 in a subtraction circuit 38. The circuit 38 is adjusted particularly to maintain a particular count number difference corresponding to the difference in count numbers present at the point of engagement (A). Any deviation results in a signal which is added at a suitable level to the signals formed in summing point 36. Circuit 38 is turned on for operation on count state 4, because position synchronism between the motor and the rolls can occur only in the constant speed phase.

The circuit 38 could be constructed and adjusted, for example, to ignore count state differences of a fixed number, e.g., of one, because it cannot be expected that the pulse trains from transducers 11 and 12 occur in phase synchronism. The counters 33 and 43 may not be at count state 4 by the time profile 51 is entered into, but the control through position comparison by 38 will adjust the relative position of the linear motor to follow the progressive angular positions of the rolls during rolling.

This operation will be true only, if in fact the grating of and in transducer 12 is selected in relation to the markings on the rotating disk in transducer 11 so that for the particular constant speed of rolling both pulse rates are exactly equal (or are an integral multiple of each other e.g., on the binary scale so that count comparison may involve less than all stages of one counter). Otherwise, circuit 38 may have calculation functions to provide some digital arithmetic (multiplication) to take care of any non-integral relation between the pulse rate frequencies from transducers 11 and 12.

The constant speed phase is maintained until count state 200 has been reached by counter 31. The function of the control circuit following count state 200 is to stop the motor and reverse it as fast as possible. The rolls disengaged from the bloom at that phase. The velocity profile to be followed is the initial portion of parabola 52. The command signal is generated by counting down the counter 33 from count state 4 and use the resulting output as deceleration command.

First of all, however, a switching signal issues from the count state 200 detector to change the phase of the inverter 25 output by 180° (control circuit 47) to obtain deceleration. Additionally, the detector of count state 200 is used in the respective input circuits of counter 33 and 43 to switch them to resume counting but in a down counting mode, beginning with the respective count state (which is 4 in counter 33) still held in the counters. The third function of count state 200 detector 32 is to turn off position control circuit 38.

As stated, the counter number for and in 43 to be used could be the same as was maintained at the end of the initial acceleration phase, to serve as starting point for the deceleration speed tracking of the motor. One could use the actual speed signal at the phase point 200 (output of 35) and adjust additionally the acceleration rate for circuit 34 (proportionality factor in the $V \sim t$ relation) and for circuit 44/45 (proportionality factor in the $V \sim \sqrt{S}$ relation) so that with certainty the linear motor reverses on angle and phase count 204.

As count state 204 is reached, the motor has decelerated to zero and stops briefly for reversal. Counters 33 and 43 stop at zero count and detection of count state 204 is used to switch the input circuit for counters 33 and 43 to operate again as up counters. Since the linear motor was, in fact, servoed to begin deceleration on phase point and pulse count 200 in counter 31, it can, indeed, be inspected that the linear motor reverses on phase count 204 in counter 31 coinciding with zero count states in counters 33 and 43.

Following reversal of the motor and passage through phase point 204, counters 33 and 43 are now counting as up counters again, both beginning with count state zero while on the other hand, counter 41 begins down counting. Circuit 34 meters again a speed command signal that is proportionate with time but phased to the rolls; circuits 43, 44 meter and accumulate passage of travel path increments, so that circuit 45 can form the speed feedback signal, proportional to the square root of the metered travel path beginning from the rear reversal (phase point 204). Thus, parabola 52 can be continued as a result of the operation of circuits 34, 44 and 45.

The preceding reversal as to a.c. phase in the inverter 25 may require a polarity change in the outputs of circuit 40 to retain the negative feedback characteristics in the operation. However, proper adaptation of sign to the needed signal level may in parts be carried out in the immediate control circuit for the inverter 25.

As a consequence, and following reversal, the linear motor accelerates at a constant rate and advances the feed mechanism. Looking at FIG. 6, one can see that the active surfaces of the rolls are disengaged from the bloom when the rolls turn from phase position 204, through 282 to 360°/0°. Phase 282 is the midpoint of the non-rolling phase and at that point the linear motor should change from acceleration to deceleration (presumed to operate with similar rates). Upon reaching count state 282 by counter 31, counter 33 should have reached count state 78 in this example. On the other hand, forward counter 43 should have the same count state as down counter 41 as the midpoint between two reversals of the linear motor. One can see here that the purpose of providing the speed feedback through a counting and square rooting process. If properly adjusted, the signal of circuit 45 will represent the speed of the linear motor as having been built up progressively through position counts, so that as a result of feedback operation the linear motor reaches the midpoint position as evidenced by similar count states in counters 41 and 43 at the same time roll position counter 31 reaches count state 282 and counter 33 reaches count state 78. How any discrepancy here can be eliminated will be discussed shortly. Presently, it is assumed that as a result of tight concurring position and speed tracking rolls 10 reach position 282, or 78 position counts from recycling point 360/0 by the same time motor position counter 41 passes through its respective midpoint position, H/2.

The detector signal from the count state 282 detector switches the input circuit of counters 33 and 43 to down counting. Alternatively as to counter 43, one may use now the output counter 41 as input for A/D converter 44 to obtain the deceleration profile. Additionally, the count state 282 signal is used to change again the phase of the output of inverter 25 to switch from acceleration to deceleration of motor 15. The advancing feed mechanism is, therefore, subjected to dynamic braking after having traversed the midpoint position. The velocity travel path profile is parabolically reduced to zero along curve 53. On count state zero, detector counters 33 and 43 are changed again to the up counting mode to complete parabola 53, following forward reversal of the feed mechanism until reaching the point of constant speed operation.

Count state zero in counter 31 is either reached through recycling or by a separate reset pulse (if such a pulse is actually provided, the counter 31 does not have to be of the recycling variety). Counter 41 has also reached zero but a reset pulse should be provided separately on motor reversal to avoid accumulation of errors. A complete new cycle is started. One could, for example, actively synchronize the position counters additionally on previous counts, such as the rear reversal point (count state 204) or the transition point 282, to avoid cumulative errors. One can see additionally here the purpose of the position controlled servo circuit. Not only must the feed mechanism be advanced for the next pass as fast as possible, but the front reversing from advance to retraction must be position controlled to occur rather accurately ahead of the phase point (4) of re-engagement of the bloom by the rolls, so as to obtain speed synchronism for the engagement between bloom and rolls. One the other hand, if the bloom retracts too early it may slip away from the rolls so that rolling is not carried out or for an insufficiently long section. The position tracking near that reversal point is, therefore, the most critical aspect. On the other hand, since fast advance is needed (because less time is available for advance than for retraction over the same distance), phase and position controlled acceleration and deceleration should be and is carried out under continuous position tracking of the motor and the feed mechanism.

Proper operation of the circuit as described depends to a considerable extent on the reliability as to the onset of deceleration. In accordance with a refinement one may take into consideration that phase count 282 (or 78 in 33) may occur before or after counters 41 and 43 register coincidence. Detection of either one of the midpoint counts can be used to control the transition from acceleration to deceleration. Assuming the phase count 282 is also used here, then any discrepancy in count states between counter 41 and 43 can be ascertained and used to change the effective deceleration rate (gain factor in circuits 34 and 45), so that motor 15 is dynamically braked along a modified speed profile, i.e., with a faster or slower rate of deceleration depending on whether the path for that deceleration is longer or shorter than the midpoint position of the motor. It is repeated, that maintaining the reversal point at roll phase 360°/0° is the principle objective.

Alternatively, one can provide a different mode of last phase, fine position tracking. The profile 50 has intersecting acceleration - deceleration curves 52, 53. However, it may be advisable to use a short period of constant speed operation, following acceleration (52) and prior to deceleration (53) to permit the motor to catch up with the rolls as to phase and position tracking. In this case, acceleration and deceleration is chosen somewhat higher than in case of transitionless change from acceleration to deceleration. This particular constant speed phase then servoes the motor, so that its position count and the position count of the rolls reach particular numbers simultaneously from which to commence deceleration. This aspect of the circuit is related to the point that one may not need acceleration to maximum possible speed before beginning to brake dynamically. This depends actually on attainable motor speed and more specifically, on the angular range of rolling vs. roll disengagement and feed mechanism advance. Conceivably, a period of constant speed may be interposed in the advance phase as stated or may result automatically in that the signal levels of circuits 34, 44 and 45 are limited. In such a case the transition point from which to begin deceleration and detection of proper count states are used to control the deceleration towards the front reversal at phase point 360/0. In any event, the feed mechanism must be slowed, so that it actually reverses accurately ahead of the re-engagement between rolls and bloom for the next pass.

For reasons of simplification, it has been assumed that acceleration and deceleration rates are basically the same throughout. This, however is not necessary in principle, it is merely convenient for ease of implementation. Each phase may well use different rates. Moreover, if phase 360°/0° does not exactly coincide with actual reversal of the motor, the acceleration rate for profile portion O → 4 may be adjusted algebraically (gain in 34 and 44) as utimately engagement of the bloom by the rolls at point 4 (A) is the primary goal to be reached. Additionally, correction may be had e.g., manually in the form of an override in any of the phases and full automation may not be relied upon exclusively.

Finally, the following modification should be mentioned. The content of counter 43 could be digitally processed to form the square root of the path count and to multiply that number for example with a factor which is the square root of two over the acceleration rate. The resulting number can then be digitally subtracted from the digital number held in counter 33, and the resulting digital difference is then converted into an analog signal for use in input network 36 of amplifier 40.

The invention is not limited to the embodiments described above but all changes and modifications thereof not constituting departures from the spirit and scope of the invention are intended to be included.

We claim:

1. Apparatus for control of the feed mechanism in a rolling mill of the pilger variety, wherein the feed mechanism as coupled to a bloom retracts from the rolls of the mill during a rolling pass and is advanced in between passes, comprising:

an electrical linear motor connected for driving the feed mechanism;

first means connected to the rolls for providing a sequence of signals representing progressing angular positions of the rolls;

second means connected to the linear motor for providing a sequence of signals representing progressive positions of said linear motor as reciprocating the feed mechanism; and a control circuit for the linear motor and connected to the second means to establish therewith a feedback loop for the control of the linear motor, the control circuit being further connected to the first means and being responsive to the signals from the first means to determine the motion of the linear motor on the basis of particular relative positions of the rolls including a phase of motion wherein the speed of the retracting feed mechanism and bloom is servoed to the rolling speed followed by a phase of fast advancing terminating in a phase of reversal in the direction of motion in particular response to the signals of the first means as representing the beginning of the respective next rolling pass.

2. Apparatus as in claim 1, wherein the control circuit operates for servoing the said reversal ahead of a re-engagement of the bloom by the rolls.

3. Apparatus as in claim 2, wherein the control circuits provide for coincidence between said re-engagement and a constant speed of retraction.

4. Apparatus as in claim 1, wherein the first and second means each provide a sequence of pulses, the control circuit including counter means for tracking progressive positions of the rolls.

5. Apparatus as in claim 1, wherein the control circuit includes means operating in response to the signals from the first means to obtain a velocity profile corresponding to three phases, a constant speed phase during rolling, a first substantial constant deceleration - acceleration phase and a second deceleration - acceleration phase wherein the changeover from deceleration to acceleration constitutes said reversal, the control circuit servoing the linear motor in respect to said profile.

6. Apparatus as in claim 5, wherein said profile is generated so that said reversal occurs prior to re-engagement of the bloom by the rolls, the re-engagement occurring at about the beginning of the constant speed phase.

7. Apparatus for control of the feed mechanism in a rolling mill of the pilger variety, wherein the feed mechanism retracts from the rolls of the mill during a rolling pass and is advanced in between passes, comprising:

an electrical linear motor connected for driving the feed mechanism;

first means connected to the rolls for providing a sequence of signals representing progressing angular positions of the rolls;

first circuit means, connected to the first means for providing a velocity profile for said linear motor in dependance upon the angular position of the rolls, including a forward deceleration - reverse acceleration phase for the feed mechanism with directional reversal to occur prior to re-engagement of the bloom by the rolls followed by a velocity corresponding to the speed of the bloom during a rolling pass for retracting the feed mechanism, followed in turn by reversal and forward advance to close a profile loop;

second circuit means connected to the motor and to the first circuit means for controlling the motor in accordance with said velocity profile so that the rolls re-engage the bloom while moving in the same direction at a peripheral speed of the rolls at least approximately similar to the speed of the bloom as determined by the speed of the feed mechanism being driven by the motor.

8. Apparatus as in claim 7, wherein said first means provides a train of pulses and the first circuit means is connected to receive said pulses and includes means for counting said pulses to meter specific phases of the position of the rolls and to generate the velocity profile on the basis of said counting.

9. Apparatus as in claim 7, wherein the second circuit means includes position and speed feedbacks from the linear motor for tracking the position of the feed mechanism in response to the velocity profile.

10. Apparatus for control of the feed mechanism in a rolling mill of the pilger variety, wherein the feed mechanism retracts from the rolls of the mill during a rolling pass, in engagement with a bloom, and is advanced in between passes, comprising:

an electrical linear motor connected for driving the feed mechanism;

first means connected to the rolls for providing a sequence of electrical pulse, representing progressing angular positions of the rolls;

second means connected to the linear motor for providing a sequence of signals representing progressive positions of motor as reciprocating the feed mechanism;

first circuit means connected to the first means and counting the pulses on a cyclic basis as far as rotation of the rolls is concerned to provide particular signals respectively representing particular positions of the rolls;

second circuit means connected to the second means, and to the first circuit means, for controlling the linear motor for a particular sequence of operation depending on said particular signals, including a phase or deceleration/acceleration with reversal ahead of re-engagement of the bloom by the rolls; and third circuit means, included in the second circuit means to servo the feed mechanism.

* * * * *